US010099477B2

(12) United States Patent
Edelen et al.

(10) Patent No.: US 10,099,477 B2
(45) **Date of Patent: *Oct. 16, 2018**

(54) PRINTHEAD CONDITION DETECTION SYSTEM

(71) Applicant: FUNAI ELECTRIC CO., LTD., Daito-shi, Osaka (JP)

(72) Inventors: John Glenn Edelen, Lexington, KY (US); Steve Bergstedt, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 30 days.

This patent is subject to a terminal disclaimer.

(21) Appl. No.: 15/292,735

(22) Filed: Oct. 13, 2016

(65) Prior Publication Data

US 2017/0028724 A1 Feb. 2, 2017

Related U.S. Application Data

(63) Continuation of application No. 14/683,699, filed on Apr. 10, 2015, now Pat. No. 9,493,002.

(51) Int. Cl.
*B41J 2/14* (2006.01)
*B41J 2/045* (2006.01)

(52) U.S. Cl.
CPC ..... *B41J 2/1433* (2013.01); *B41J 2/0458* (2013.01); *B41J 2/04541* (2013.01); *B41J 2/04573* (2013.01); *B41J 2/14072* (2013.01); *B41J 2/14153* (2013.01); *B41J 2002/14491* (2013.01)

(58) Field of Classification Search
CPC ..... B41J 2/14072; B41J 2/14088; B41J 2/14153; B41J 2/1433; B41J 2002/14491
See application file for complete search history.

(56) References Cited

U.S. PATENT DOCUMENTS

| | | | | |
|---|---|---|---|---|
| 5,841,448 | A | 11/1998 | Moriyama et al. | |
| 5,992,984 | A | 11/1999 | Imanaka et al. | |
| 6,631,970 | B2 | 10/2003 | Sato et al. | |
| 6,652,053 | B2 | 11/2003 | Imanaka et al. | |
| 7,568,389 | B2 * | 8/2009 | Eguchi | B41J 2/14427 73/290 R |
| 8,172,358 | B2 | 5/2012 | Inoue | |

(Continued)

FOREIGN PATENT DOCUMENTS

JP H07-178924 A 7/1995

*Primary Examiner* — Julian Huffman
*Assistant Examiner* — Michael Konczal
(74) *Attorney, Agent, or Firm* — Amster, Rothstein & Ebenstein, LLP

(57) ABSTRACT

A fluid printhead including at least one fluid ejection element. The fluid ejection element includes a fluid chamber, a throat portion through which fluid is provided to the fluid chamber, and a heater element disposed within the fluid chamber. The fluid ejection element also includes a printhead condition detection system. The printhead condition detection system includes a first electrode at least a portion of which is disposed within the fluid chamber, the first electrode configured to receive a step voltage, a second electrode disposed within the throat portion, and a sense circuit electrically connected to the second electrode that generates an output based on the application of the step voltage to the first electrode as an indication of printhead condition.

12 Claims, 12 Drawing Sheets

(56) References Cited

U.S. PATENT DOCUMENTS

| | | | |
|---|---|---|---|
| 8,899,709 | B2 | 12/2014 | Govyadinov et al. |
| 9,493,002 | B2 * | 11/2016 | Edelen ..... B41J 2/14072 |
| 2013/0278656 | A1 | 10/2013 | Govyadinov et al. |

* cited by examiner

PRINTHEAD CONDITION DETECTION SYSTEM

CROSS-REFERENCE TO RELATED APPLICATIONS

This application is a Continuation of U.S. application Ser. No. 14/683,699, filed on Apr. 10, 2015, entitled " PRINTHEAD CONDITION DETECTION SYSTEM", the entire contents of each of which are incorporated herein by reference.

FIELD

This invention is related to inkjet printheads, and in particular to systems and methods for detecting condition of an inkjet printhead nozzle.

BACKGROUND

Detecting the health of an inkjet nozzle has been a long standing problem in the field. With scanning printheads the ability to perform multiple passes has been used to minimize the impact of missing or improperly performing nozzles. As inkjet technology pushes into the laser printer performance space, printheads with nozzles spanning the entire page width have become more common. Using this printing method yields improved print speeds but no longer allows for multi-pass printing. Therefore, a method to verify that a nozzle is jetting properly is needed.

One such method is by optical detection as disclosed in U.S. Pat. No. 8,177,318, U.S. Pat. No. 8,376,506 and U.S. Pat. No. 8,449,068, as well as others. This method requires external light sources and sensors which can add cost and complexity to the printing device. In an effort to eliminate the need for external devices, other methods have been disclosed which place impedance sensors on the ejector chip itself.

One possible implementation of this method is described in U.S. Pat. No. 8,870,322 and U.S. Pat. No. 8.899,709 and US Patent Application Publication 2014/0333694. These patents and application teach the use of either differential or single ended impedance measurements taken over time to detect the formation and collapse of thermal vapor bubbles. It is further taught that different types of nozzle conditions such as blocked or weak nozzles can be determined by external processing of the data collected from the sensors. As shown in U.S. Pat. No. 8,870,322, a method of calibration may be required to provide adequate performance of the system. These conventional techniques of detecting printhead condition require analysis of each sensor output at each ink chamber to determine whether the nozzle corresponding to that chamber is firing properly. This does not allow for a practical and efficient detection method.

SUMMARY OF THE INVENTION

An object of the present invention is to provide a practical method of stimulating an inkjet printhead and sensing the response to determine the condition of the printhead nozzles.

Another object of the present invention is to provide an fluid sense circuit that can sense the state of multiple nozzles on a single buss line.

Another object of the present invention is to provide a system that has the ability to stimulate a printhead condition detection cell using a single common input.

Another object of the present invention is to provide a printhead condition detection system that uses a cavitation protection layer as an electrode in a condition detection cell.

A fluid printhead according to an exemplary embodiment of the present invention comprises: at least one fluid ejection element comprising: a fluid chamber; a throat portion through which fluid is provided to the fluid chamber; and a heater element disposed within the fluid chamber; and a printhead condition detection system comprising: a first electrode at least a portion of which is disposed within the fluid chamber, the first electrode configured to receive a step voltage; a second electrode disposed within the throat portion; and a sense circuit electrically connected to the second electrode that generates an output based on the application of the step voltage to the first electrode as an indication of printhead condition.

In an exemplary embodiment, the at least one fluid ejection element comprises a plurality of fluid ejection elements, each fluid ejection element comprises a corresponding fluid chamber, throat portion and heater element, and the printhead condition detection system comprises a common first electrode shared by the plurality of fluid chambers, a plurality of second electrodes disposed within the throat of each corresponding fluid ejection element, and a plurality of sense circuits each electrically connected to a corresponding second electrode.

In an exemplary embodiment, the fluid printhead further comprises a stimulus node configured to receive the step voltage for delivery to the common first electrode.

In an exemplary embodiment, the fluid printhead further comprises a sense bus that receives the output from the plurality of sense circuits.

In an exemplary embodiment, the output of the sense circuit is a digital high output upon a condition that fluid is present in the fluid chamber.

In an exemplary embodiment, the output of the sense circuit is a digital low output upon a condition that fluid is not present in the fluid chamber.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
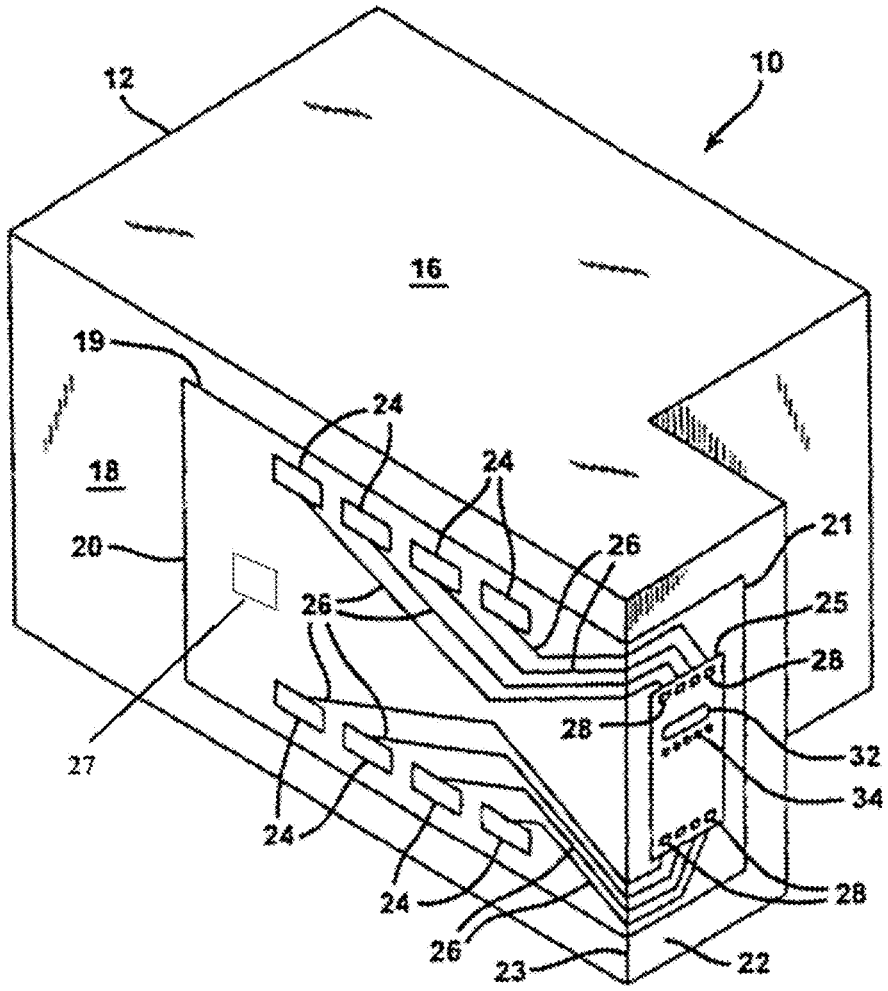
FIG. 1 is a perspective view of an inkjet printhead according to an exemplary embodiment of the present invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

In an electrochemical system an electrode used to probe a system rather than to effect a compositional change is defined as a microelectrode. Further, a microelectrode with a critical dimension less than 25 um is termed an ultra-microelectrode or TIME. According to exemplary embodiments of the present invention, a global microelectrode as well as individual band UMEs within each ejection element throat are used to sense the presence or absence of ink.

With reference to FIG. 1, an inkjet printhead according to an exemplary embodiment of the present invention is shown generally as 10. The printhead 10 has a housing 12 formed of any suitable material for holding ink. Its shape can vary and often depends upon the external device that carries or contains the printhead. The housing has at least one compartment 16 internal thereto for holding an initial or refillable supply of ink. In one embodiment, the compartment has a single chamber and holds a supply of black ink, photo ink, cyan ink, magenta ink or yellow ink. In other embodiments, the compartment has multiple chambers and contains three supplies of ink. Preferably, it includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply from a tube, for example.

Adhered to one surface 18 of the housing 12 is a portion 19 of a flexible circuit, especially a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 supports a plurality of input/output (I/O) connectors 24 thereon for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25. Those skilled in the art know various techniques for facilitating such connections. For simplicity, FIG. 1 only shows eight I/O connectors 24, eight electrical conductors 26 and eight bond pads 28 but present day printheads have much larger quantities and any number is equally embraced herein. Still further, those skilled in the art should appreciate that while such number of connectors, conductors and bond pads equal one another, actual printheads may have unequal numbers.

The heater chip 25 contains a column 34 of a plurality of fluid firing elements that serve to eject ink from compartment 16 during use. The fluid firing elements may embody thermally resistive heater elements (heaters for short) formed as thin film layers on a silicon substrate or piezoelectric elements despite the thermal technology implication derived from the name heater chip. For simplicity, the pluralities of fluid firing elements in column 34 are shown adjacent an ink via 32 as a row of five dots but in practice may include several hundred or thousand fluid firing elements. As described below, vertically adjacent ones of the fluid firing elements may or may not have a lateral spacing gap or stagger there between. In general, the fluid firing elements have vertical pitch spacing comparable to the dots-per-inch resolution of an attendant printer. Some examples include spacing of 1/300th, 1/600th, 1/1200th, 1/2400th or other of an inch along the longitudinal extent of the via. To form the vias, many processes are known that cut or etch the via 32 through a thickness of the heater chip. Some of the more preferred processes include grit blasting or etching, such as wet, dry, reactive-ion-etching, deep reactive-ion-etching, or other. A nozzle plate (not shown) has orifices thereof aligned with each of the heaters to project the ink during use. The nozzle plate may attach with an adhesive or epoxy or may be fabricated as a thin-film layer.

A memory unit 27 stores data related to information such as, for example, the production date, the lifetime and the number of refilled times that can be made.

Figure 2:
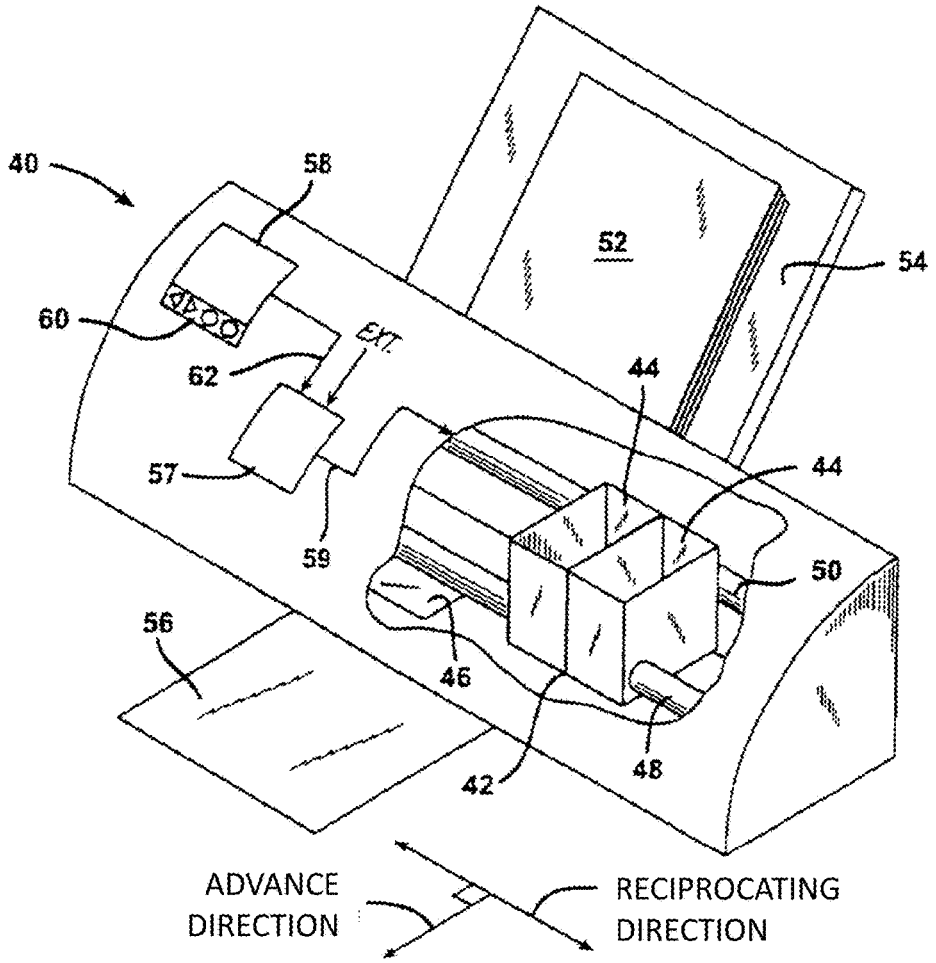
FIG. 2 is a perspective view of an inkjet printer according to an exemplary embodiment of the present invention.

With reference to FIG. 2, an external device in the form of an inkjet printer for containing the printhead 10 is shown generally as 40. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50 as is well known in the art. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be eject from the heater chip 25 at such times pursuant to commands of a printer microprocessor or other controller 57. The timing of the ink drop emissions corresponds to a pattern of pixels of the image being printed.

Often times, such patterns become generated in devices electrically connected to the controller 57 (via Ext. input) that reside externally to the printer and include, but are not limited to, a computer, a scanner, a camera, a visual display unit, a personal data assistant, or other.

To print or emit a single drop of ink, the fluid firing elements (the dots of column 34, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such ink drop may embody a single or a split firing pulse and is received at the heater chip on an input terminal (e.g., bond pad 28) from connections between the bond pad 28, the electrical conductors 26, the I/O connectors 24 and controller 57. Internal heater chip wiring conveys the fire pulse from the input terminal to one or many of the fluid firing elements.

A control panel 58, having user selection interface 60, also accompanies many printers as an input 62 to the controller 57 to provide additional printer capabilities and robustness.

Figure 3:
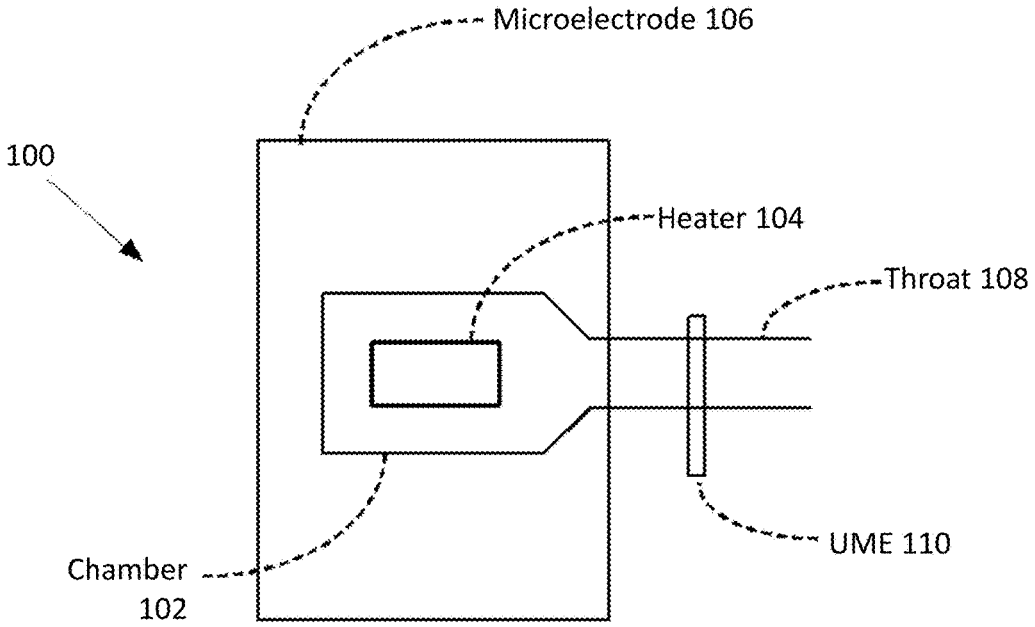
FIG. 3 is a planar view of a printhead condition detection cell according to an exemplary embodiment of the present invention.

FIG. 3 is a planar view of a fluid ejection element, generally designated by reference number 100, according to an exemplary embodiment of the present invention. The fluid ejection element 100 includes a fluid chamber 102 formed using photolithographic methods to image and develop the feature in a photosensitive material. The chamber 102 may have a thickness of about 15 um. A thin film heating element 104 is located within the chamber 102. The heating element 104 can be energized by applying a voltage potential across the device. In a typical inkjet application, the temperature at the surface of the heating element will increase from ambient to about 350° C. in less than 1 μs. In the case where the chamber is filled with an aqueous ink solution, a vapor bubble will form at the surface of the heating element and then quickly expand. It is this expansion which forces ink out of the chamber through a nozzle orifice. Typically a nozzle (not shown in FIG. 3) is located above the heating element 104. The dimensions of the heating element 104 is highly dependent on the drop size and characteristics of the liquid to be ejected, but in general the aspect ratio (Length/Width) of the element is usually between 1 and 3. In an exemplary embodiment, the heating element 104 is formed by depositing a thin layer, about 800 A, of TaAlN.

After ink or other fluid is ejected from the chamber 102 through the nozzle opening the vapor bubble will collapse. The collapse of the bubble exerts a significant cavitation force which would quickly destroy the heating element 104. It is for that reason that a cavitation protection layer is applied about the heating element 104. In an exemplary embodiment, the cavitation protection layer is made of tantalum. While tantalum is typically used because of material hardness and chemical resistance, other materials could be used as well. As explained in more detail below, the cavitation protection layer functions as a first electrode 106 of a condition detection cell corresponding to the fluid ejection element 100 within a printhead condition detection system. Other fluid ejection elements within the printhead share the same cavitation layer, which also serves as first electrodes 106 for each condition detection cell corresponding to those ejection elements.

The fluid ejection element 100 also includes a second electrode 110. The second electrode 110 is preferably disposed in the throat 108 of each fluid ejection element. For the purposes of the present disclosure, the "throat" may be defined as a passage that provides a flow path between the fluid via (not shown) and the fluid chamber 102. The throat 108 is formed from the same material and in the same manner as the chamber 102. The second electrode 110 is a band UME and, in an exemplary embodiment, may also be made of Ta and deposited and etched at the same time as the first electrode/cavitation protection layer 106 for process efficiency. It should be understood that the second electrode 110 may be formed from other materials that provide improved printhead condition sensor performance.

Figure 4:
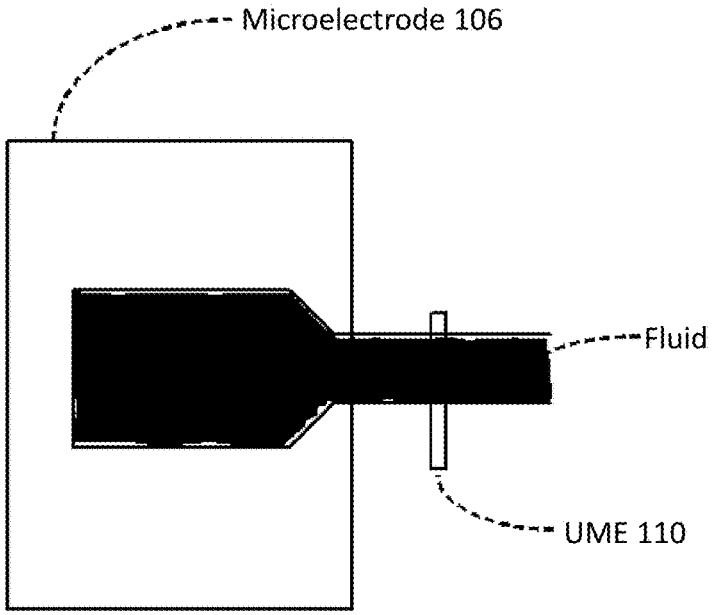
FIG. 4 is a planar view of a printhead condition detection cell according to an exemplary embodiment of the present invention in a steady state.
Figure 5:
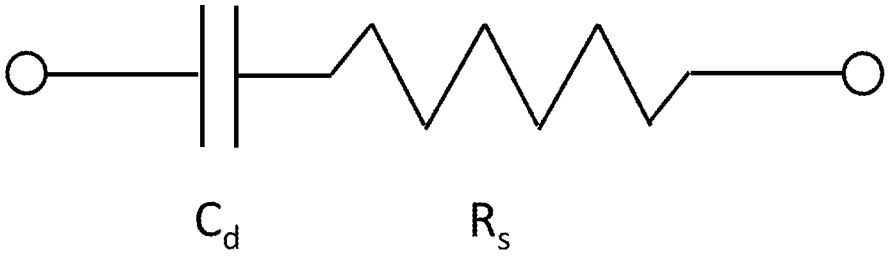
FIG. 5 is a circuit diagram representing the electrochemical interaction between elements of the printhead condition detection cell of FIG. 4.

FIG. 4 shows the fluid ejection element 100 in a steady state with the element filled with liquid. As shown, the first electrode 106 and second electrode 110 are now fluidly connected. It is known from electrochemical principles that the relationship between the fluid and the first and second electrodes 106, 110 can be represented by an electrical circuit with a resistor, Rs, representing the solution resistance and the capacitor, Cd, representing the double layer capacitance formed at the electrode to fluid interface when biased. Such an electrical circuit representation is shown in FIG. 5. It should be understood that in the case where liquid is not present the double layer capacitor does not exist and the series resistance would appear as an open circuit.

With this understanding of the properties of the condition detection cell it is possible to consider practical methods of detecting the presence or absence of liquid between the two electrodes. For inkjet printing or other liquid dispensing applications is it desirable to be able to sense the condition of each chamber on the ejector chip. This design goal must be balanced with the desire to keep die size as small as possible as well as maintaining a simple interface.

Figure 6:
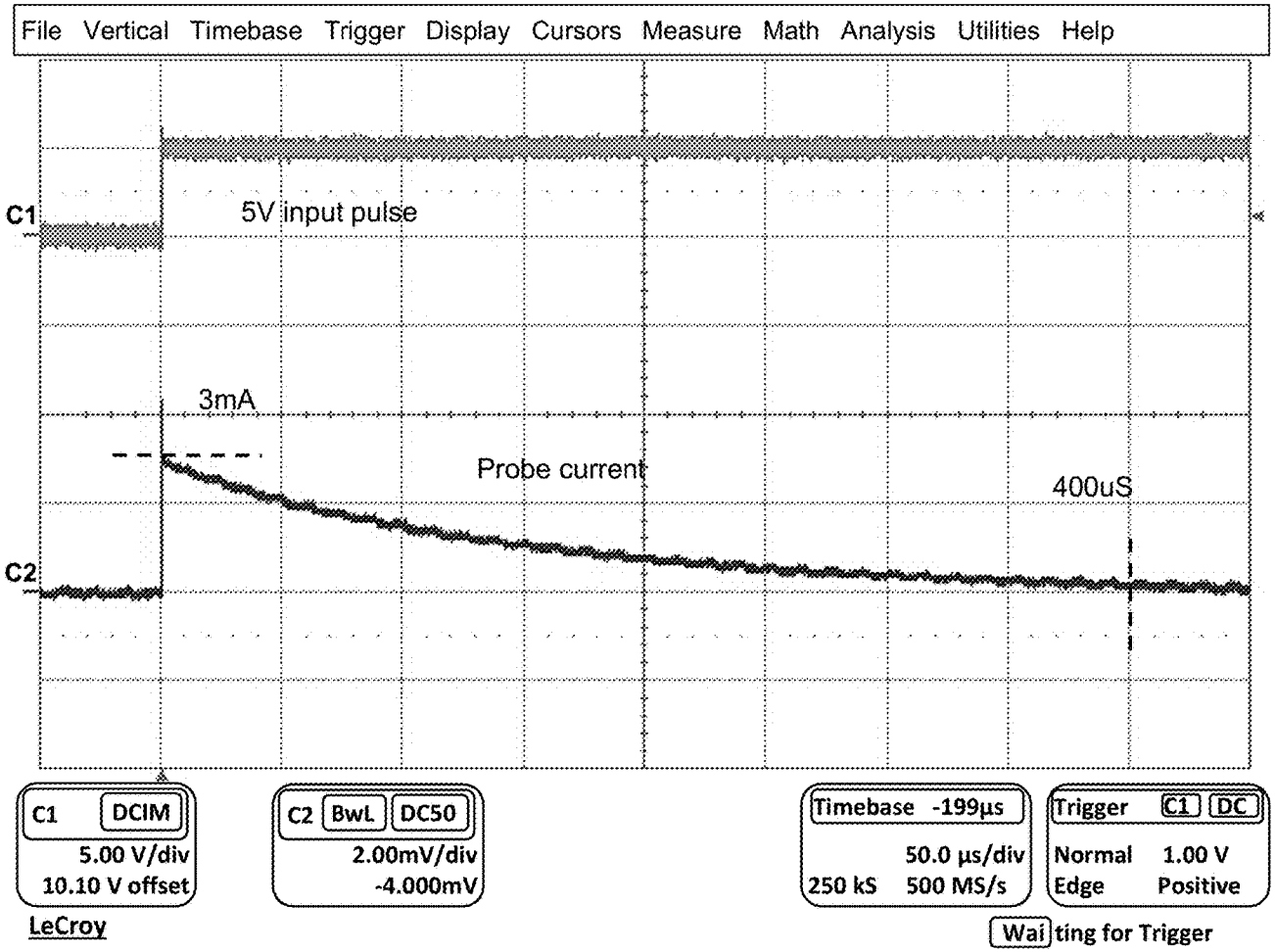
FIG. 6 shows the measured response to a 5V input for a condition detection cell with ink present according to an exemplary embodiment of the present invention.
Figure 7:
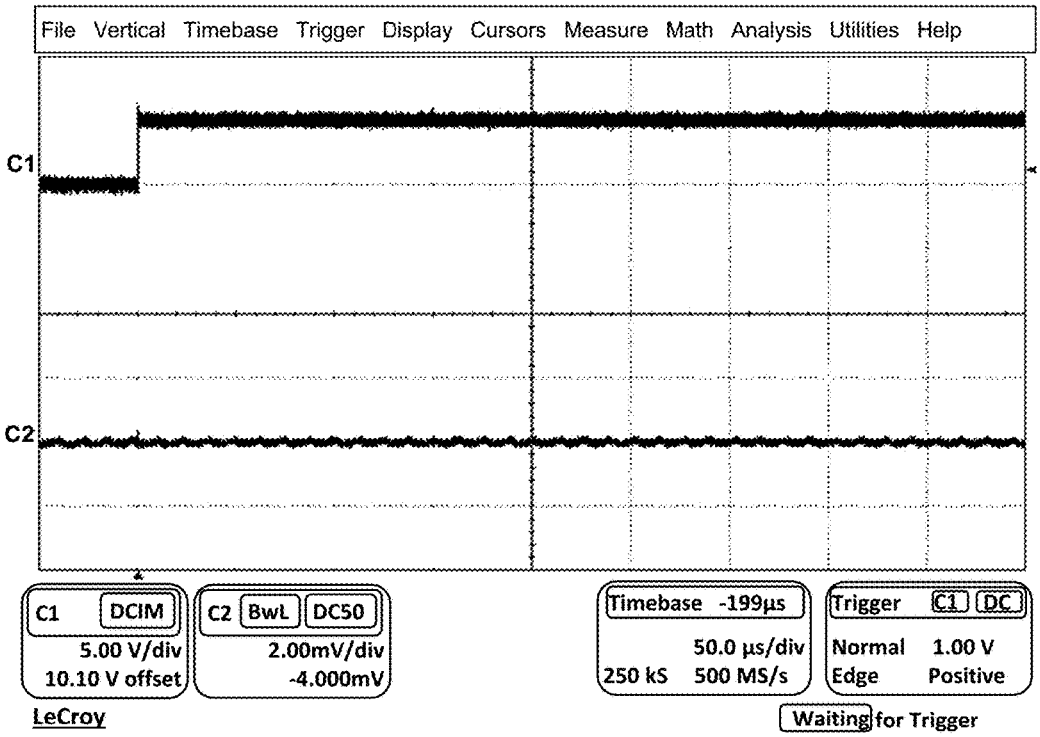
FIG. 7 shows the measured response to a 5V input for a condition detection cell with no ink present according to an exemplary embodiment of the present invention.
Figure 8:
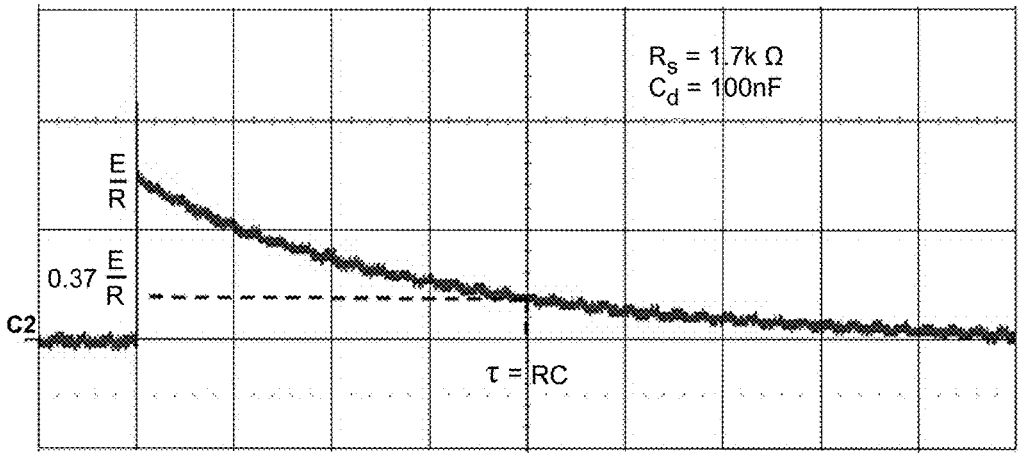
FIG. 8 shows how the equivalent series resistance and double layer capacitance can be calculated based on the response of a condition detection cell according to an exemplary embodiment of the present invention.
Figure 9:
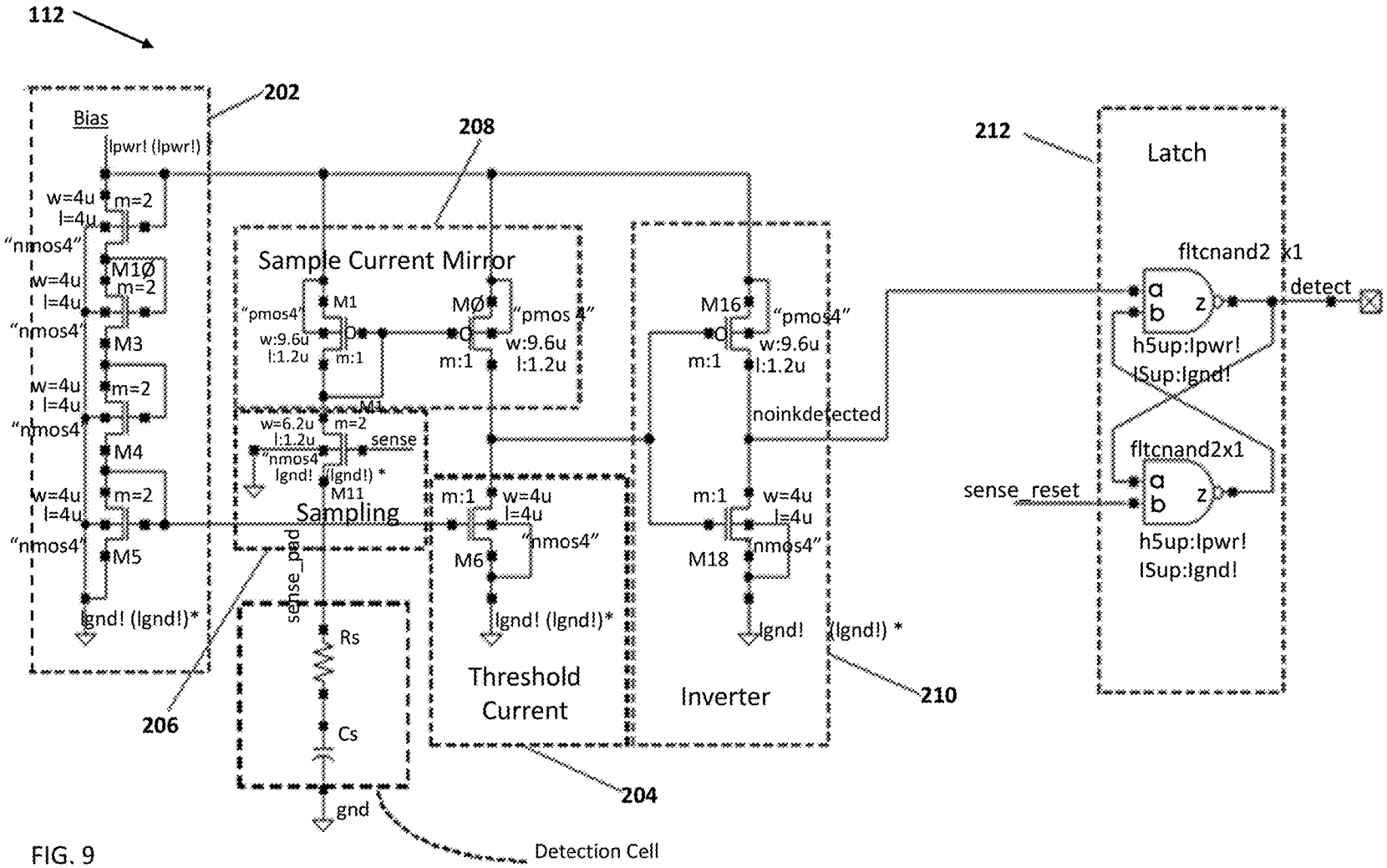
FIG. 9 is a circuit diagram of a sense circuit according to an exemplary embodiment of the present invention.

In an exemplary embodiment of the present invention, a voltage step is applied to the system and the resulting response is used to sense the presence or absence of liquid from the system. FIG. 6 shows the measured response to a 5V input for a condition detection cell with ink present. FIG. 7 shows the measured response with no ink present. Further, FIG. 8 shows how the equivalent series resistance and double layer capacitance can be calculated based on the response of the cell. While this enables the use of a simple input, a voltage step, a practical method of measurement is still needed. A preferred sense circuit 112 for making such a measurement is shown in FIG. 9.

The sense circuit 112 provides a digital high output when ink is present in the condition detection cell and a digital low output when the cell is empty. There is no need for complicated and space consuming sampling of the cells analog output to determine the state of the cell. This represents a significant on-chip space savings.

The sense circuit 112 of this exemplary embodiment may be grouped into seven functional blocks. The bias block 202 develops a current bias used by the threshold detection block 204. The sampling block 206 connects the sampling pad to the sample current mirror 208 when the sense pin is at a high state. The sample current mirror 208 then replicates the ink current sensed and the current flows into the threshold current detection block 204. If the mirrored current sensed is greater than the threshold current then ink is present and the inverter block 210 produces a low state at the input of the latch block 212 and the latch block detect pin will go to a high state. The latch is required because of the transient charging nature of the current that flows through the ink. If ink is not present then the sampled current will be much less (almost zero) than the threshold detect current. The inverter will then produce a high state which also produces a low state at the latch detect output. The latch is a memory element and its state will persist until its sense_reset pin is forced to a high state. The high state of the sense_reset pin will clear the latch's detect output pin to a low state. In summary, a transient current pulse through the ink causes the latch to trigger and its detect output pin will be latched at a high state or the "ink sensed" state.

Figure 10:
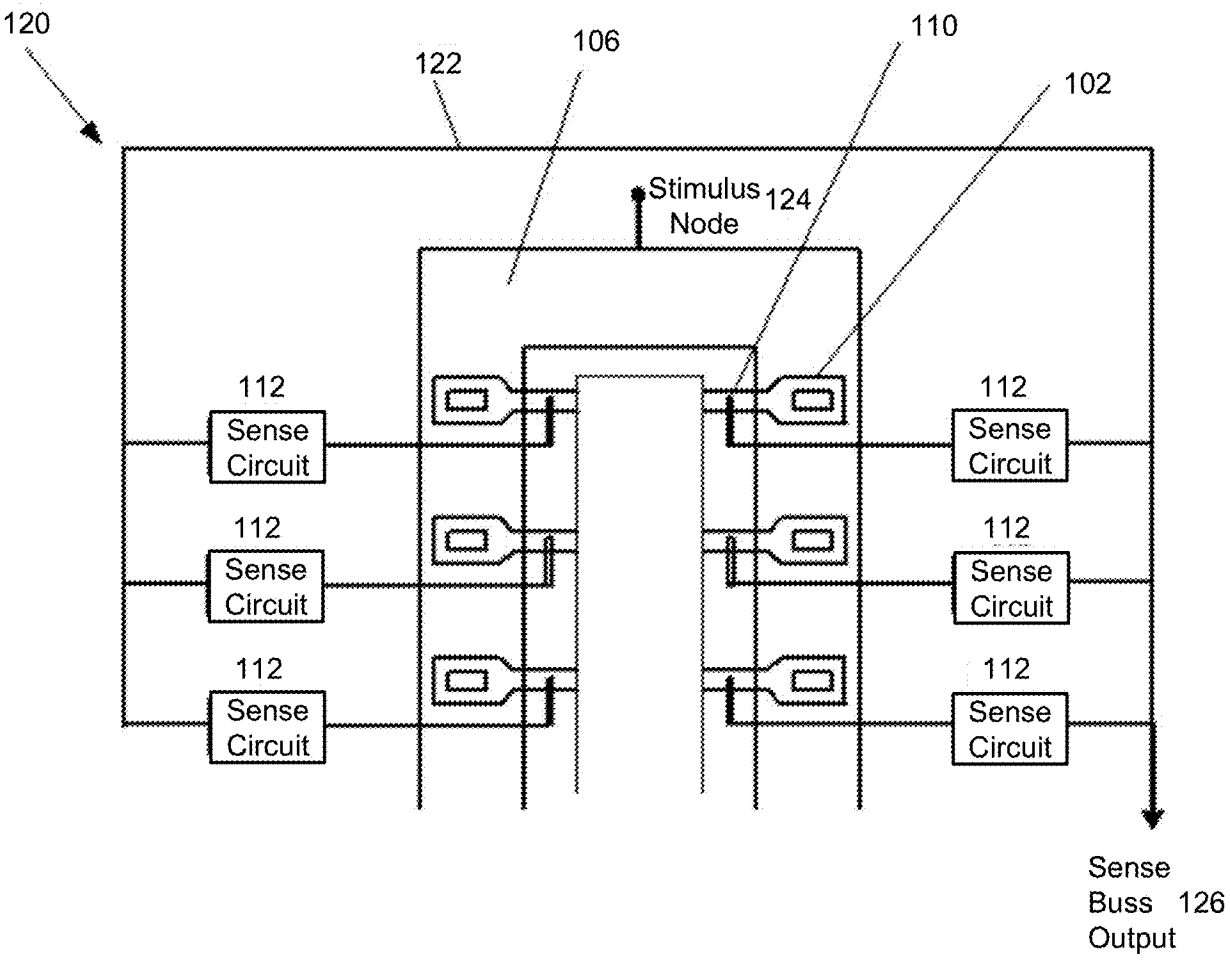
FIG. 10 is a block diagram of a printhead condition detection system according to an exemplary embodiment of the present invention.

FIG. 10 shows a condition detection system, generally designated by reference number 120, according to an exemplary embodiment of the present invention. To continue the goal of providing a practical method of sensing the state of all nozzles on a chip, the output of the sense circuit 112 for all fluid chambers can be connected to a single sense bus 122. Additionally, since the cavitation protection layer acts as the first electrode common to all chambers, a voltage step function can be applied to a single stimulus node 124 that delivers the step function to the cavitation protection layer. The state of all chambers can be read at a single sense bus output 126. The sense bus 122 may be configured to be normally digitally high. Thus, the ink sense circuits 112 may be configured so that the output of any one ink sense circuit 112 may pull the sense bus 122 to the low state. For example, reading a digital low value from the sense bus output 126 would indicate that at least one of the chambers had deprimed or that the cartridge was depleted of ink. Alternatively, reading a digital low value may indicate that ink is still present in at least one of the chambers after printing, which would indicate that at least one of the heaters did not fire.

Figure 11:
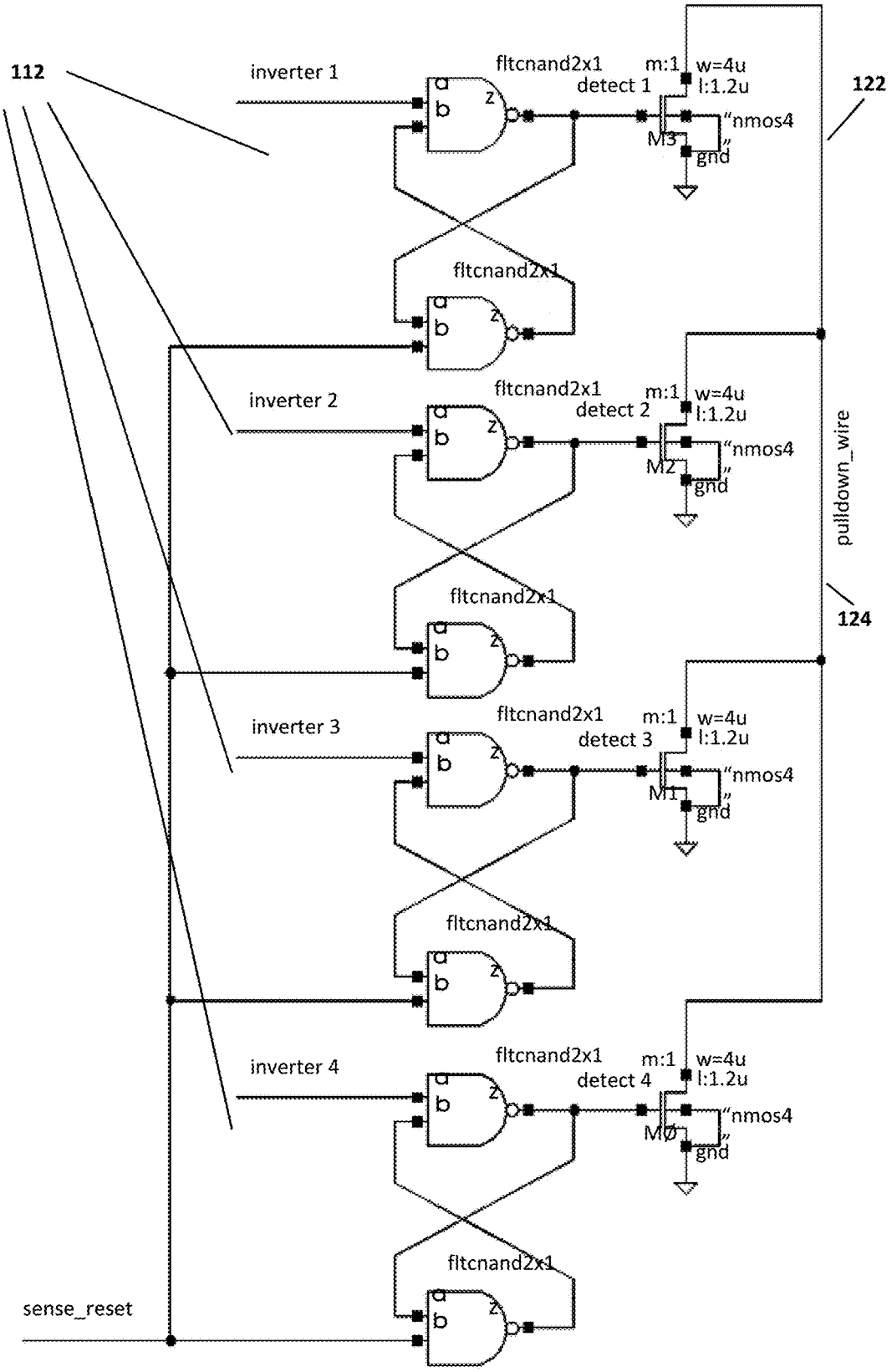
FIG. 11 is a circuit diagram showing electrical connection between ink sense circuits and a sense bus according to an exemplary embodiment of the present invention.

FIG. 11 is a circuit diagram showing the electrical connection between the sense bus 122 and a plurality of ink sense circuits 112 according to an exemplary embodiment of the present invention. In this embodiment, the sense bus 122 is used to detect any ink sense failures on a plurality of ink cells. The sense bus 122 in this embodiment is a single pulldown wire 124 that connects multiple ink sense cells in a "wired or" connection. If any one of the ink sense circuits 112 has ink detected then its NMOS pulldown transistor will be activated and the sense bus 122 will be "pulled" to a logic low state. This allows a strategy where a group of inkjet heaters may be fired and immediately sensed using the "sense" signal to detect a failure or non-firing heater because the ink is still present. This method allows many heaters to be checked at the same time and requires only one wire to connect any or all heaters in the array. This reduces the time required to detect failures and reduces the area needed for the detection system.

Figure 13:
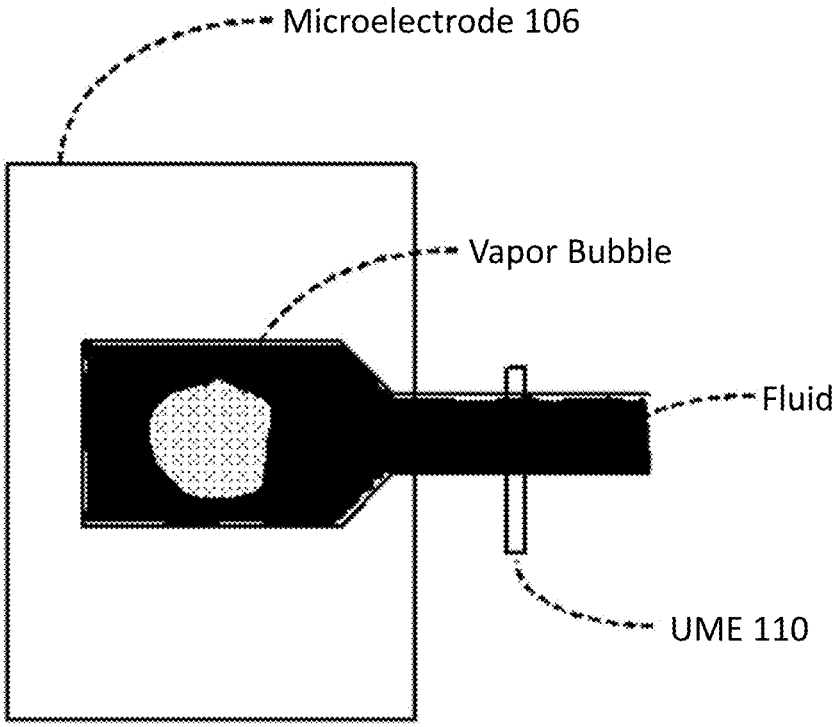
FIG. 13 is a planar view of a printhead condition detection cell according to an exemplary embodiment of the present invention with a vapor bubble beginning to form.
Figure 14:
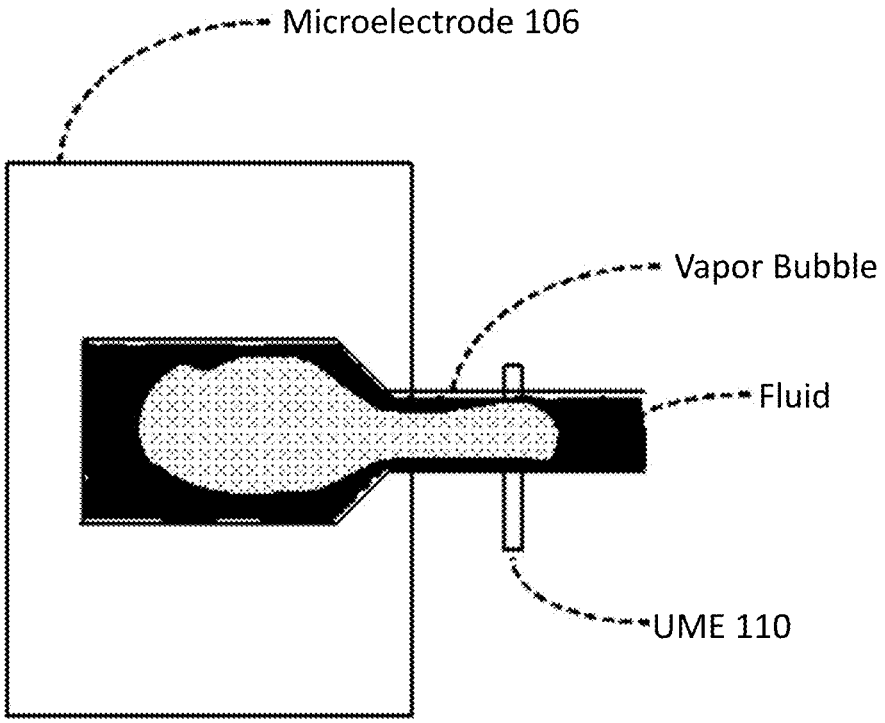
FIG. 14 is a planar view of a printhead condition detection cell according to an exemplary embodiment of the present invention with a vapor bubble fully formed.

In an exemplary embodiment, the systems and methods described could be used to detect the presence or absence of a vapor bubble in the chamber. As previously discussed and as shown in FIG. 13, ink is ejected from a chamber by the growth of a vapor bubble at the surface of the heating element. As shown in FIG. 14, after the ink is ejected from the chamber, the vapor bubble continues to grow into the throat until the pressure from the ink in the via overcomes the force of the vapor bubble and the bubble collapses and ink refills the chamber. As shown in FIG. 13, the first and second electrodes 106, 110 are still in fluid commination when the bubble begins to nucleate. At some time after the drop is ejected the vapor bubble extends to the second electrode 110, thereby breaking the fluidic path. In this state, the cell will read the same as if the chamber was empty. By sensing the cell at the appropriate time after nucleation, it is possible to determine if the bubble properly formed and the system can be used to gauge the overall health of the nozzle.

Figure 12:
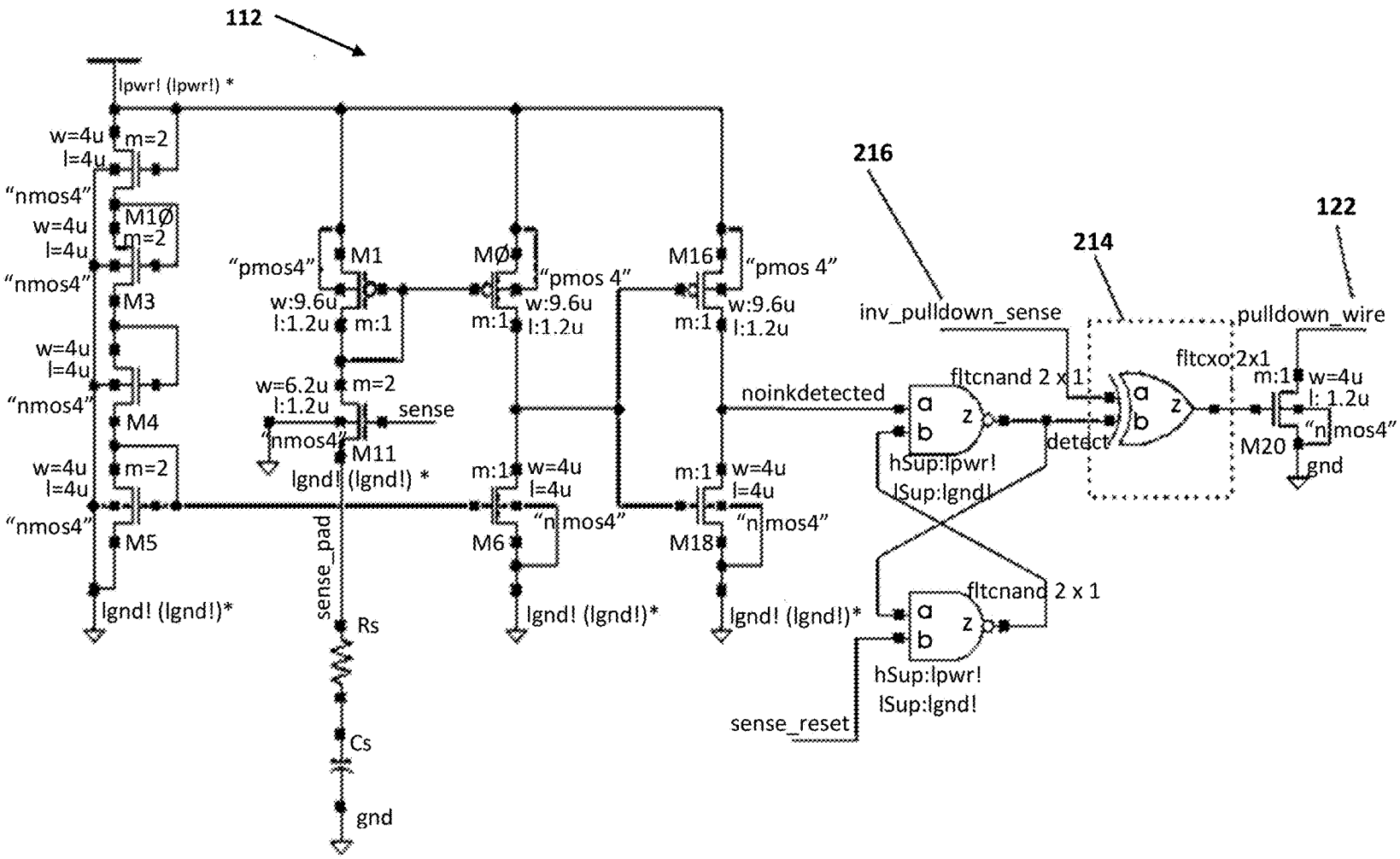
FIG. 12 is a circuit diagram showing electrical connection between an ink sense circuit and a sense bus according to an exemplary embodiment of the present invention.

The pulldown wire or bus connection may be extended to sensing, depending on the test mode, either the presence of ink or the lack of ink (i.e., a "bubble") on any inkjet heater cell in a group. In this regard, as shown in FIG. 12, the ink sense circuit described previously may be modified to include an "exclusive or" (xor) logic cell 214 and a new input signal, the "inv_pulldown_sense" (ips) signal 216. The ips signal 216 is used with the xor logic cell 214 to invert the logic state required to activate the pulldown NMOS transistor. A logic low ips signal will cause the pulldown circuit to activate or set the pulldown wire to a low state when any ink sense cell has ink present. A logic high state ips signal will cause the pulldown circuit to activate or set the pulldown wire to a low state when any ink sense cell does not have ink (i.e., detect a bubble). Thus, the ips signal allows any groups of inkjet heater cells to be checked for ink present (non-firing heater) or ink absent (a bubble) using a single wire and sensing at the correct instant in time.

In an exemplary embodiment, rather than all chambers being sensed at once, individual chambers may be addressed and sensed so that the chamber where ink is not present can be determined.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A fluid printhead, comprising:

a plurality of fluid ejection elements, each fluid ejection element comprising:

a fluid chamber; and a heater element disposed within the fluid chamber; and a printhead condition detection element comprising:

a common first electrode formed by a cavitation layer that is common to each fluid chamber, the common first electrode receives a step voltage;

a plurality of sense circuits each electrically connected to a corresponding one of a plurality of second electrodes respectively coupled to the plurality of fluid ejection elements for outputting an indication of printhead condition based on the application of the step voltage to the common first electrode, each sense circuit outputting a digital low output upon a condition that fluid is present in each respective fluid chamber.

2. The fluid printhead of claim 1, further comprising a stimulus node that receives the step voltage for delivery to the common first electrode.

3. The fluid printhead of claim 1, further comprising a sense bus that receives the output from the plurality of sense circuits.

4. The fluid printhead of claim 3, wherein the sense bus is maintained at a digital high output in normal default operation.

5. The fluid printhead of claim 3, wherein the sense bus outputs a logical OR of the output from the plurality of sense circuits.

6. The fluid printhead of claim 1, wherein the output of each sense circuit is a digital high output upon a condition that fluid is not present in each respective fluid chamber.

7. A fluid printer comprising:

a housing; and one or more printhead assemblies movably connected to the housing so that the one or more printhead assemblies eject fluid onto a print medium as the one or more printheads move relative to the housing in accordance with a control mechanism, wherein at least one of the one or more printhead assemblies comprises:

a fluid printhead, comprising:

a plurality of fluid ejection elements, each fluid ejection element comprising:

a fluid chamber; and a heater element disposed within the fluid chamber; and a printhead condition detection element comprising:

a common first electrode formed by a cavitation layer that is common to each fluid chamber, the common first electrode receives a step voltage;

a plurality of sense circuits each electrically connected to a corresponding one of a plurality of second electrodes respectively coupled to the plurality of fluid ejection elements for outputting an indication of printhead condition based on the application of the step voltage to the common electrode, each sense circuit outputting a digital low output upon a condition that fluid is present in each respective fluid chamber.

8. The fluid printer of claim 7, further comprising a stimulus node configured to receive the step voltage for delivery to the common first electrode.

9. The fluid printer of claim 7, further comprising a sense bus that receives the output from the plurality of sense circuits.

10. The fluid printer of claim 9, wherein the sense bus is maintained at a digital high output in normal default operation.

11. The fluid printer of claim 9, wherein the sense bus outputs a logical OR of the output from the plurality of sense circuits.

12. The fluid printer of claim 7, wherein the output of each sense circuit is a digital high output upon a condition that fluid is not present in each respective fluid chamber.

* * * * *